United States Patent [19]

Bean

[11] 4,216,691

[45] Aug. 12, 1980

[54] OCTAVE ASSIGNMENT SYSTEM FOR ELECTRONIC MUSICAL INSTRUMENT

[75] Inventor: Eric R. Bean, South Bend, Ind.

[73] Assignee: C. G. Conn, Ltd., Oakbrook, Ill.

[21] Appl. No.: 867,907

[22] Filed: Jan. 9, 1978

[51] Int. Cl.[2] ..... G10H 1/02

[52] U.S. Cl. ..... 84/1.01; 84/DIG. 2; 84/DIG. 11; 84/DIG. 23; 84/DIG. 9

[58] Field of Search ..... 84/1.01, 1.03, 1.17, 84/DIG. 9, DIG. 11, DIG. 23, DIG. 2

[56] References Cited

U.S. PATENT DOCUMENTS

| | | | |
|---|---|---|---|
| 3,809,787 | 5/1974 | Mochida | 84/1.01 |
| 3,930,429 | 1/1976 | Hill | 84/1.01 |
| 3,955,460 | 5/1976 | Southard | 84/1.17 |
| 4,016,792 | 4/1977 | Schrecongost | 84/DIG. 2 |
| 4,031,786 | 6/1977 | Kaplan | 84/1.03 |
| 4,070,943 | 1/1978 | Faulkner | 84/1.01 |

*Primary Examiner*—Gene Z. Rubinson

*Assistant Examiner*—William L. Feeney

*Attorney, Agent, or Firm*—Kenyon & Kenyon

[57] ABSTRACT

An electronic organ uses several top octave synthesizer circuits for producing the various tones used in the organ. Each of the top octave synthesizers is capable of producing any tone which can be produced by the organ. As a consequence, the outputs of each synthesizer are applied to a coupler circuit, which in turn is connected to an octave assignment switching tree for directing the tones coupled to the inputs of the switching tree to individual leads, each corresponding to a different octave in the range of tones produced by the organ. The similar octave leads from each of the different octave switching circuits are connected together to common flute octave buses, so that the filters connected to the output buses have substantially fewer tones appearing at the input than one which would have the full tone range of the organ. Typically, the range of tones appearing at a filter input is one octave or less.

6 Claims, 3 Drawing Figures

OCTAVE ASSIGNMENT SYSTEM FOR ELECTRONIC MUSICAL INSTRUMENT

RELATED PATENTS AND APPLICATIONS

U.S. Pat. No. 3,955,460 issued May 11, 1976, directed to a DIGITAL MULTIPLEX ELECTRONIC MUSICAL INSTRUMENT and co-pending applications Ser. No. 834,245 filed on Sept. 19, 1977 and Ser. No. 867,908 filed on Jan. 9, 1978, all assigned to the same assignee as this application, are related to the subject matter of this application.

BACKGROUND OF THE INVENTION

This invention is broadly related to the field of electronic musical instruments, particularly electronic organs or other electronic musical instruments having a keyboard such as electronic pianos, accordions and the like. The term "organ" as used throughout the specification and claims is intended in a generic sense to include these other electronic musical instruments. In addition, reference to the actuation of key switches or coupler switches and the like is intended to cover the actuation of such switches by whatever means may be employed, such as directly by action of the musician's fingers or indirectly through intervening levers, apertures, switch closings, touch responsive switches, etc.

In the design of electronic organ, an attempt is made to faithfully reproduce as nearly as possible the musical sounds and tones which are developed by true pipe organs in response to the playing of the electronic organ by a musician. In order to simulate as many pipe organ sounds as possible, electronic organs utilize intramanual and intermanual couplers employed with at least two manual keyboards and a single pedalboard. A pair of pedalboards and an even larger number of manual keyboards are used in more complex electronic organs. The manual keyboards generally encompass several octaves and the pedalboards usually one or more octaves. In addition, a typical electronic organ includes a relatively large number of playing stops or tabs which are associated with each of the keyboards to permit selection of different organ voices for the tones produced by those keyboards by changing the timbre, tone quality, and the like.

To generate the tones capable of production by such an organ, a separate stable oscillator could be provided for each of the many tones. This, however, is prohibitively expensive; and because of the tonal interrelationships between all of the various tones, tuning of such an organ and maintaining tuning of such an organ becomes nearly impossible from a practical standpoint. A system known as a top octave frequency synthesizer system (TOS) has been developed which overcomes the need for using a large number of expensive stable oscillators and instead utilizes a single stable oscillator to provide the tones for the top octave of the organ. Divider circuitry then is employed to generate all of the other tones, and tuning of such an organ becomes a relatively simple matter since only a single oscillator or a small number of oscillators are used in the organ.

While a single oscillator and top octave synthesizer can be used for an entire organ, problems occur if several different divider circuits are connected to the same top octave synthesizer output. If some form of synchronization is not used between the different divider circuits from the same top octave synthesizer output, then it is possible that some tones will have phase reinforcement of harmonics and others phase cancellation of harmonics. This results in very unnatural quality music production by the organ. To overcome these disadvantages, a number of different top octave synthesizers have been utilized in an organ, so that different notes for different octaves in the different manuals of the keyboard are produced by different top octave synthesizers. When such synthesizers are dedicated to a block of keys or a particular part of the organ, however, it still is necessary to use a relatively large number of synthesizer circuits.

To reduce the complexity of the organ, top octave synthesizers known as programmable top octave synthesizers have been developed to permit any key closure to produce any tone in the organ from a given synthesizer circuit. When a number of these circuits are used in an organ along with an assignment or control circuit for assigning different top octave synthesizers to different keys as the organ is being played, maximum efficiency in the electronics of the organ is realized so far as the tone generating portion is concerned.

Top octave synthesizers typically are square-wave generators; so that while their output tones are acceptable for strings, they are not acceptable in square-wave form for the production of flute sounds. It is necessary to filter the outputs of the top octave synthesizer circuits to change the square-wave outputs to sinusoidal wave outputs for the reproduction of proper flute sounds from the instrument. If top octave synthesizers having a capability of tonal production over more than an octave (and typically over the entire range of frequencies of the organ) are used in a system, the filters connected to the outputs of the top octave synthesizers necessarily have been required to be extremely wide band filters. Such filters cannot attenuate all harmonics of a tone over the entire tonal range of the organ and as a consequence do not produce the desired quality of flute tones from the instrument.

It is desirable to provide an electronic organ or other electronic musical instrument with a limited number of top octave synthesizer circuits, each capable of producing any note in the full range of notes produced by the organ, and to group the tone outputs from the top octave synthesizers into subgroups, such as octaves; so that more effective filtering of the tones for producing flute tones can be accomplished by relatively narrow band filters.

SUMMARY OF THE INVENTION

It is an object of this invention to provide an improved electronic musical instrument.

It is another object of this invention to provide an improved electronic organ utilizing a minimum number of top octave synthesizer tone generator circuits.

It is another object of this invention to provide an improved electronic organ employing octave assignment circuitry connected to the outputs of the tone generator circuit for supplying all tones in each of the different note subgroups to note subgroup buses unique to such notes.

It is a further object of this invention to provide an improved electronic organ utilizing a plurality of top octave synthesizer circuits each capable of producing any of the tones obtainable from the organ.

In accordance with a preferred embodiment of the invention, an electronic organ includes several tone generators each capable of producing tones in all of the several octaves of tones which can be played by the organ. A corresponding number of note subgroup assignment circuits each are coupled to receive the outputs from a different one of the associated tone generators, and each of these note subgroup assignment circuits has a plurality of output leads each corresponding to a different note subgroup of tones produced by the organ. All of the corresponding note subgroup output leads from the note subgroup assignment circuits are connected together in common in different note subgroup buses. Separate control circuits are coupled to each of the tone generators and the corresponding note subgroup assignment circuits for controlling the tone produced by the tone generator and for interconnecting the tone generator outputs with the note subgroup leads which correspond to the note subgroup in which such produced tones belong.

DETAILED DESCRIPTION OF THE PREFERRED EMBODIMENT

Figures 1, 3:
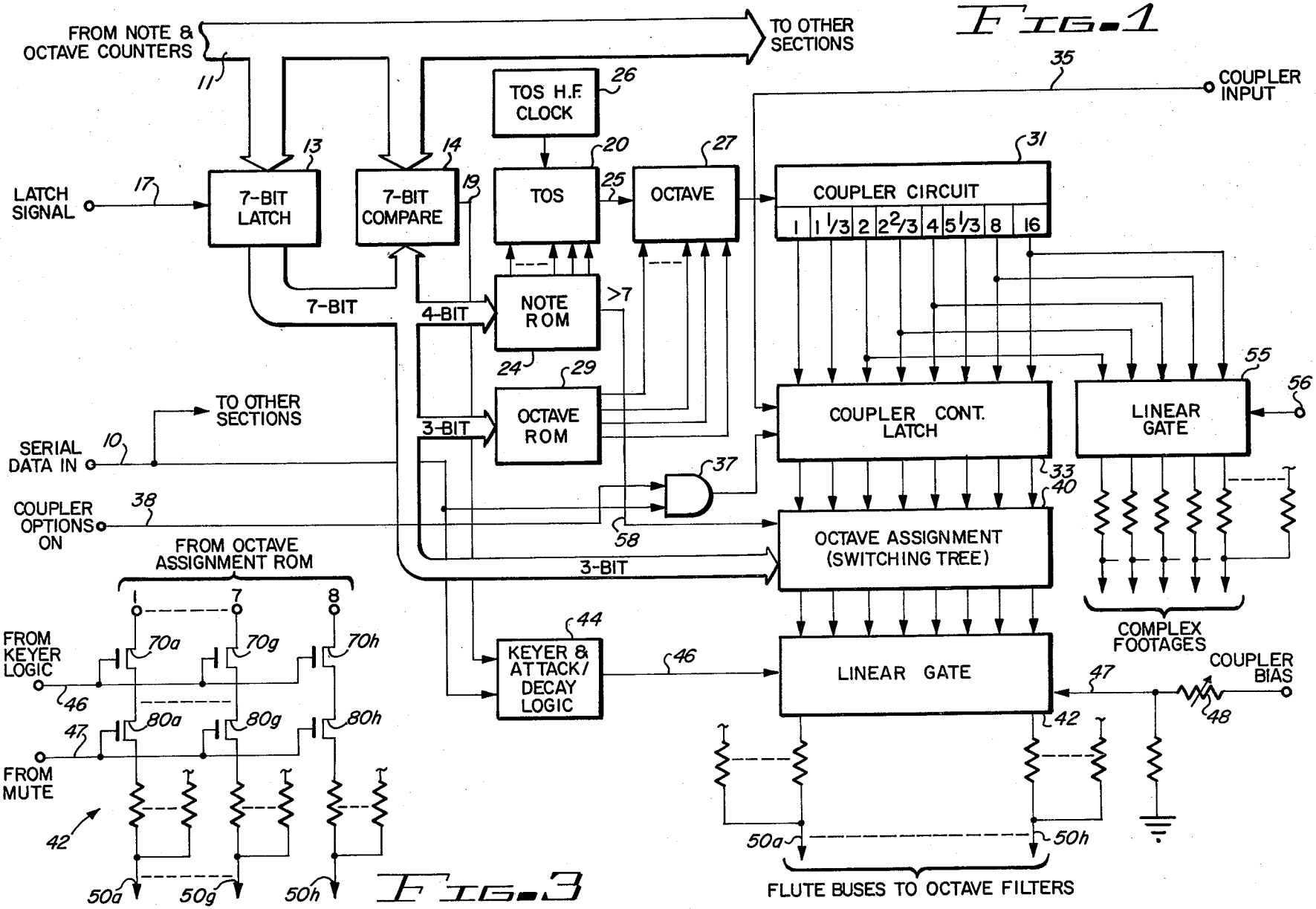
FIG. 1 is a block diagram of a preferred embodiment of the invention.
FIG. 3 is a detailed circuit diagram of another portion of the circuit shown in FIG. 1.

In the drawings, the same or similar reference numerals are used throughout the several figures to designate the same or similar components.

While the detailed description of the preferred embodiment describes a note subgroup in which the subgroup is an octave and is hereafter called the octave assignment circuit, it is not limited to an octave and each subgroup may contain fewer or greater numbers of notes such as one-half octave subgroups or two octave subgroups. While the waveforms going to the note subgroup assignment circuit are square-waves in the preferred embodiment, it is not limited to only square-waves and may be other waveforms such as sawtooth, triangle or pulse.

Referring now to FIG. 1, there is shown the note and octave assignment portion of an electronic organ circuit which preferably is of the type used in a digital multiplex system such as disclosed in the aforementioned U.S. Pat. No. 3,955,460 and which forms a portion of the system disclosed in the aforementioned co-pending applications. The disclosures of this patent and these two co-pending patent applications are incorporated herein by reference.

In a digital multiplex electronic organ of the type disclosed in co-pending application Ser. No. 867,908, the digital multiplex serial data (which may be produced in any suitable manner) is supplied over an input lead 10. This data is synchronized with outputs from note and octave counters supplied over seven leads 11 from the counters to a seven-bit latch 13 and a seven-bit comparator 14 for each different note generating section of the organ. The operation of these counters in conjunction with the serial multiplex data is explained in detail in the co-pending application, Case 4298.28, and will not be described further here.

Also as described in that same co-pending application, whenever a note is to be assigned to a particular top octave synthesizer tone generator, a latch signal is applied over a latch signal input lead 17 to the seven-bit latch 13, which then stores these seven-bits of data appearing on the leads 11 at the time of the latch signal pulse on the lead 17. This data comprises four bits of data which specify the particular note of the octave to be produced and three bits of data which identify the octave in which that note appears. These two portions of the seven-bit data then comprise all of the information necessary to generate any note in any octave in the organ system. The control for the generation of this note is effected by the output of the seven-bit latch circuit 13 in which four outputs address a note decoding ROM (read only memory) 24 which in turn selects the top octave synthesizer note to be played.

Since the note name and octave identification supplied over the seven leads 11 is in synchronism with the serial multiplex data on the lead 10, this information continuously changes and recycles for each frame of the serial multiplex data. So long as the seven-bit latch 13 is latched with a particular note and octave identification, the comparator 14 produces an output signal on the lead 19 once per frame to continously renew this information in the TOS lead circuit 20.

The top octave synthesizer circuit 20 is of conventional configuration, driven by a high frequency oscillator clock circuit 26 and supplied with note information from the note decoding ROM circuit 24. The note ROM circuit 24 is supplied with the four bits of the outputs of the latch circuit 13 which carries the parallel encoded note identification. The circuit 24 preferably is a binary decoder circuit which supplies a decoded output signal on an appropriate one of twelve leads to the top octave synthesizer circuit 20 to cause the signal appearing on the output lead 25 of the circuit 20 to correspond to the note of the highest octave in the system which corresponds to the signal from the output of the note ROM circuit 24.

The selection of the particular octave in which the note is to be reproduced is controlled by an octave divider circuit 27, which also may be of conventional configuration and which is commonly used in conjunction with top octave synthesizer circuitry. The dividing ratio of the octave divider 27 is controlled by an octave ROM circuit 29. This circuit in turn is supplied with the parallel three bits of the outputs from the seven-bit latch 13 which carry the binary encoded octave information for the tone to be produced by the synthesizer circuit. The octave ROM circuit 29 is also a binary decoder converter circuit which enables one of eight leads supplied to the octave divider circuit 27 to cause its division ratio to be in accordance with the selected octave of the tone to be reproduced by the synthesizer system shown.

As is well known, electronic organs include couplers which are operated in conjunction with the keying of particular notes or with the keying of all of the notes from a particular keyboard to produce tones of related frequencies in addition to the base or root tone produced by the keyboard and constituting the output of the octave divider 27 of the top octave synthesizer circuit. These related coupling tones or pitches are produced by a coupler circuit 31 which may be of any suitable configuration to supply the fifth related signals of various footages for both the octave square-wave signal (for the flutes) and complex signals. The coupler circuit block 31 also may include fold backs for some tones whenever a keyboard multiplex data time slot would require an audio output in excess of $C\#_8$ to $C_9$ at the upper footages, since these audio outputs would be above the highest tones produced, for example, in an organ having an eight octave tonal range.

The coupler generator 31 produces eight outputs, corresponding to all of the flute footages 16 foot through 1 foot, and these are coupled to the inputs of a coupler control latch circuit 33. The latch circuit 33 is controlled by coupler input signals over a lead or leads 35 supplied by the coupler control tabs and circuitry (not shown) of the electronic organ. In addition, the latch 33 is set or latched once per frame of the serial data input signal stream by the output of a coincidence gate 37 which is enabled at the beginning of each frame by the coupler-options-on line 38 going high to pass signals appearing on the serial data input line 10 to operate the coupler control latch circuit 33.

The circuit 33 includes series pass signal gates which pass the selected tone signals on the coupler footage output leads to corresponding inputs of an octave assignment switching circuit 40. The eight leads interconnecting the coupler control latch circuit 33 and the inputs of the octave assignment circuit 40 carry the selected tone signals corresponding to the coupler input controls on the lead 35 for each frame of the serial data information from the multiplex circuit (not shown). Thus at any given time, one or more of the selected tone signals available from the coupler generator 31 are supplied through the coupler control latch 33 to the octave assignment circuit 40.

The function of the octave assignment circuit 40 is to allow only frequencies of a given octave to appear on any one output lead. As shown in FIG. 1 there are eight output leads from the octave assignment connected to eight inputs of a linear gate keying circuit 42. Each of the eight output leads from the circuit 40 has signals on it corresponding to a unique different one of the eight octaves of tones which can be produced by the organ.

The linear gate circuit 42 comprises the output stage of the keyer and attack decay logic circuit 44 which, through the gate circuit 42, controls the attack, sustain and decay of any tones supplied to the gate 42 from the octave assignment circuit 40. The keying signals are applied to the gate circuit 42 over a lead 46, and the gate circuit 42 also has another input 47 to which is applied a variable mute control, illustrated as being effected by a potentiometer 48, to either block the passage of tone signals by the gate circuit 42 or to adjust the level of the tone signals for balancing the output of the gate 42 with corresponding outputs of similar gates used for the other TOS circuits in the organ.

All of the eight outputs from the linear gate circuit 42 are connected together in common with corresponding ones of the outputs from similar linear gate circuits 42 in each of the other tone generator sections (not shown) of the organ. This is illustrated diagrammatically for the first and eighth octave outputs from the gate circuit 42. The summation of all of these tone signals for each of the octaves of tones produced by all of the top octave synthesizer circuits in the organ are applied to eight common flute buses 50A through 50H, which in turn may be connected through suitable octave wide filter circuits (not shown) to change the square-wave signals to sinusoidal signals representative of the desired flute tonal effect to be produced by the organ.

In addition to the flute outputs from the coupler circuit 31, supplied through the coupler control latch 33 to the octave assignment circuit 40, the coupler circuit 31 provides selective outputs to the complex keying section of the organ. Specifically, the outputs corresponding to two foot, two and two-thirds foot, four foot, eight foot, and sixteen foot are supplied to a linear gate circuit 55 which is similar to the linear gate 42 and which is controlled by gating signals supplied on an input lead 56 from a source (not shown). Complex signals are keyed by footage not by octave as in the flute section. In addition, there also is no coupler control, so that all available footages, sixteen foot through two foot, are keyed onto the complex keying output lines. All of the required complex footages then are selected externally to the circuit shown in FIG. 1 in the manner which is well known in the art.

Figure 2:
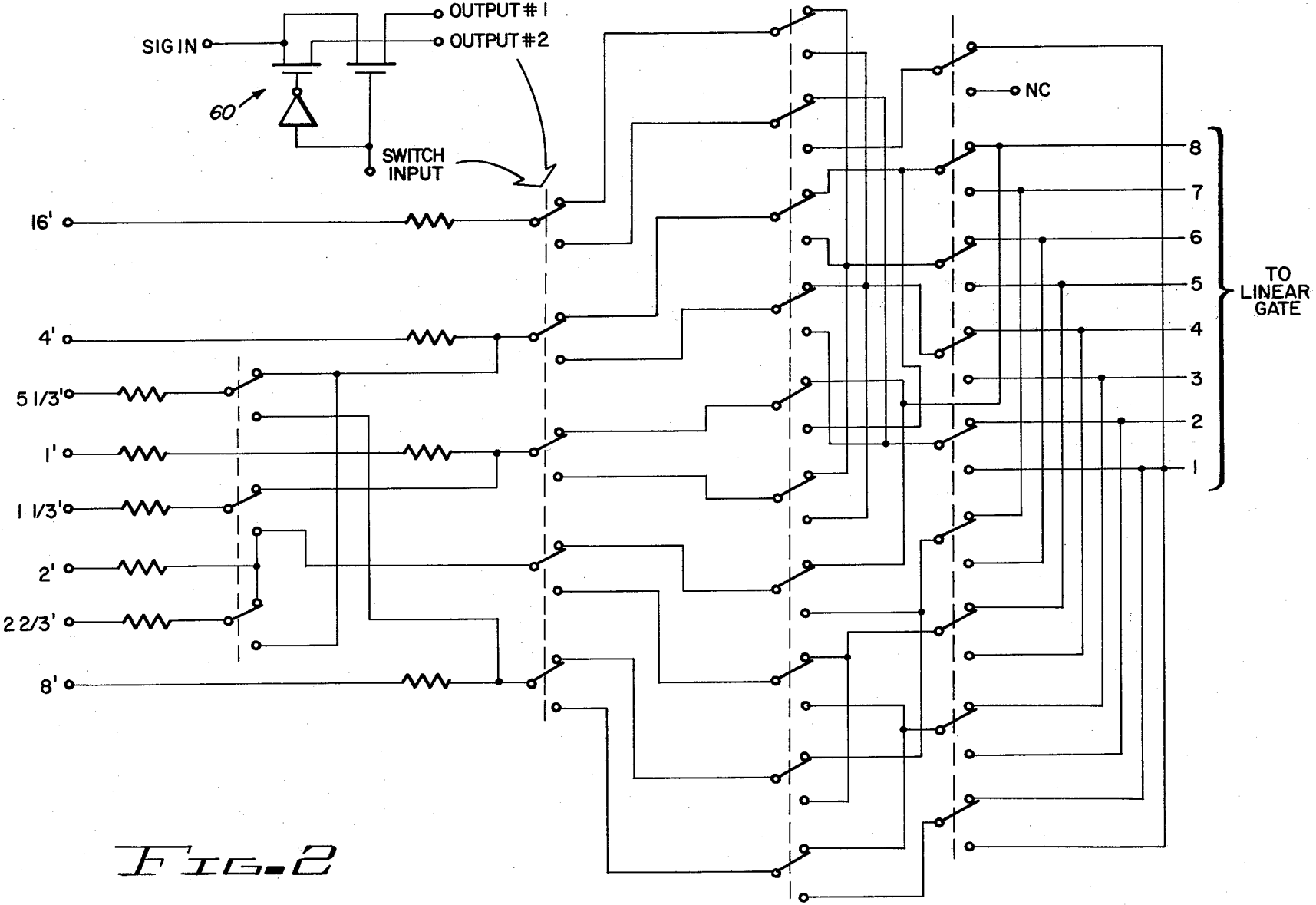
FIG. 2 is a detailed circuit diagram of a portion of the circuit shown in FIG. 1.

Reference now should be made to FIG. 2, which illustrates the functional switching effective in the octave assignment switching circuit 40 to interconnect the tone signals appearing on the flute output footages from the coupler control latch circuit 33 to the appropriate one of the eight octave output leads supplied to the linear gate circuit 42. The octave assignment circuit 40 comprises a switching tree circuit controlled by inputs from the three parallel leads of the output of the latch circuit 13 carrying the binary encoded octave information, and an input from the most significant bit of the four-bit note code. This bit is applied over a lead 58 (FIG. 1) from the note ROM circuit 24 to the octave assignment circuit 40.

Each of the switches in the octave assignment select tree circuit 40 consists of an array of FET (field-effect transistor) pass gates. In operation, the output frequency of any given footage changes by octaves as the encoded note is played from different keyboard octaves. In order to place any given footage output on the proper output octave wide bus 50A through 50H, the octave code enables the pass gates in the circuit 40 to steer the signal to the proper keyer and octave bus. All of the fifth related footages are passed through an additional select gate driven by the most significant note-name bit line 58. This is necessary because of the octave change occurring in mid-octave in relation to the even footages, and is accomplished by placing the fifth related footages in a higher octave any time the note played is higher than the seventh note in the octave. The outputs from the octave select tree then are keyed by the linear gate circuit 42 to the appropriate ones of the octave square-wave output buses 50A through 50H which in turn are connected to the octave wide filtering (not shown) to produce the desired flute tones from the instrument.

The circuit of FIG. 2 is illustrated in the form of four groups or banks of single-pole double-throw switches, each group shown as interconnected to a corresponding one of four control lines. In actual practice, however, each of these switches comprises an FET signal pass gate of the type illustrated in the circle 60 in FIG. 2. This is a conventional type of pass gate; and it is responsive to binary input signals, as is apparent from an examination of the circuit configuration of the gate 60. When the binary input signal is high or positive, the right-hand one of the transistors in the pass gate is rendered conductive, and the left-hand transistor is nonconductive. When the switch signal input is a binary zero or is low, the converse is true since the inverter causes the left-hand transistor to be conductive and the right-hand transistor then becomes nonconductive. The particular type of signal pass switch or gate which is utilized, however, is not important so long as it operates as a signal pass single-pole double-throw switch.

The eight different footage inputs from the coupler latch control circuit 33 are shown identified with the appropriate footage designations on the left-hand side of FIG. 2. The signals appearing on any one or more of these inputs then pass through the switching tree circuitry 40 to the appropriate one of the eight output octave bus leads, identified as such on the right-hand side of FIG. 2.

Each of the four banks of switches are shown as interconnected by dotted lines representative of the fact that these switches are operated in unison simultaneously by controls on these dotted lines. As explained above, in actual practice these controls are binary signals for operating appropriate FET pass gates. The representation of these binary signals in the logic circuit shown in FIG. 2 is that whenever a binary "1" appears on the control (switch input) for the switches in a bank of switches, the switches are moved to their uppermost position. On the other hand, whenever a binary zero occurs on the input signal line for operating that bank of switches, all of the switches of the bank are operated to their lowermost position.

As illustrated in FIG. 2, the leftmost bank of switches (consisting of three switches) is the one coupled to and controlled by the signals appearing on the lead 58 of FIG. 1; and a binary "1" appears on this lead whenever the note which controls the operation of the TOS circuit 20 is the seventh or higher note in the octave. If the note is the sixth or lower note, the switches of this bank are operated to their lowermost or binary "0" position.

The other three banks of switches, from right to left in FIG. 2, represent the binary encoded logic for the parallel-encoded three-bit binary code designating the selected octave. The least significant bit is on the right, and the most significant bit is on the left of these three switch banks. These designations are illustrated in FIG. 2 as $2^0$, $2^1$ and $2^2$ powers, respectively, from right to left in FIG. 2.

It is not considered necessary to follow through the operation of all of the possible combinations which occur through the different binary positions which can be assumed by these four different banks of switches, but it should be noted that the tone signals appearing on any of the footage input leads are rerouted through the switching tree 40 to the appropriate one of the eight octave leads in which those tone signals appear for any combination of notes, octaves, and coupler information supplied to the coupler control latch circuit 33.

All of the circuitry shown in FIG. 1 is duplicated for each of the different root notes which the organ is capable of simultaneously producing. For example, if six different root notes may be simultaneously played, the circuitry of FIG. 1 is repeated six times, with the serial data on the lead 10 connected to each of the sections and the seven leads 11 connected to each of the sections. In such an organ, as described previously, the corresponding outputs from the linear gates 42 in each of the tone producing sections of the organ are interconnected in common to the eight flute buses 50A through 50H.

The number of tone generating circuits is not critical. It could be more than six or less than six depending upon the requirements of the particular instrument in which the system is used. Each of the note producing sections is capable of producing any note in any octave of the instrument. Even so, the octave assignment 40 operates to direct any note in the first octave to the octave output lead which is connected to the first octave output bus 50A, any note in the second octave to the octave output bus 50B and so on, with all of the notes in octave eight in any of the note generating circuits or tone generating circuits being directed to the octave output bus 50H.

Without describing the specific routes taken by tones in all of the different octaves for all of the different combinations of footages in conjunction with FIG. 2, a pair of specific examples for two different chords (the notes of which are each produced by a different note generating TOS circuit combination) will be specifically described in conjunction with FIG. 2. Before entering into this description, however, it should be noted that in the organization of the organ described in the above mentioned patent and co-pending patent applications, the octaves electrically are grouped from C sharp to the next higher C, so that each C note of an octave is actually grouped with the notes of the next lower musical octave. This is done because the top note of the keyboard is a C, and this octave grouping provided the most convenient organizational arrangement. As a consequence, the note $C_4$ is grouped in the octave frequencies with the other notes appearing in the third octave of the instrument rather than the fourth octave, where all of the other notes, such as $E_4$ and $G_4$ of the same musical octave appear. Any other octave grouping could be used since it is not significant which twelve notes are in any particular octave grouping, but only that the octave buses handle a frequency range equal to the range of a single octave, and that all of the octaves are present from the lowest one to the highest one in the system.

Assume that the chord $C_4$, $E_4$ and $G_4$ is played on the organ. These three different notes are processed by three different circuits of the type shown in FIG. 1. The note $C_4$ is encoded in octave number three for the reason described above, and carries the binary designation 011. Since the notes $E_4$ and $G_4$ both are classified, in accordance with the above explanation, in the fourth octave, these carry the octave encoding designation of 100. In addition, the note G is the seventh note of the selected octave, so this note will cause a binary 1 to appear on the "greater-than-seven" lead 58, whereas a binary 0 appears on this lead for each of the other two notes of this chord.

When the note $C_4$ is played, the decoded key octave information applied to the three right-hand sets of switches in FIG. 2 for the circuit 40 processing that note is such that in accordance with the binary code identifying octave 3, the bank of switches for $2^0$ are in their upper position for binary 1, the switches of bank for $2^1$ are in their upper position for binary "1" and the switches for the bank $2^2$ are in their lowermost position for binary "0". Similarly, the switches on the leftmost bank, that controlled by the lead 58 of FIG. 1, are in their uppermost position since for octaves starting at C sharp, the note $C_4$ is a note higher than seven in the octave.

For both the notes $E_4$ and $G_4$ in the chord, the respective octave assignment circuits 40 of the tone production circuits for those notes are encoded the same with respect to the octave information on the three right-hand banks of switches. These switches are encoded with the octave information 100, so that the bank of switches for the $2^0$ bank are in their lowermost position as are the switches for the $2^1$ bank. For these notes in this octave, however, the bank of switches for the $2^2$ octave binary bit are in their uppermost position. For the note $E_4$ the bank of switches corresponding to the "greater-than-seven" bank is in its lowermost position since the note E is lower than the seventh note in the octave. On the other hand, for the note $G_4$ the "greater-than-seven" bank of switches controlled by the lead 58 are in their uppermost position since the note G is the seventh note in an octave beginning with C sharp.

With the above settings of the switches in the three different octave assignment circuits 40 associated with these three different notes, the various paths for the different flute footages through the three circuits 40 result in the connections of those notes (or the corresponding notes produced by the nonunison couplers) to appear on the flute octave output buses as identified in Chart 1 below:

CHART 1

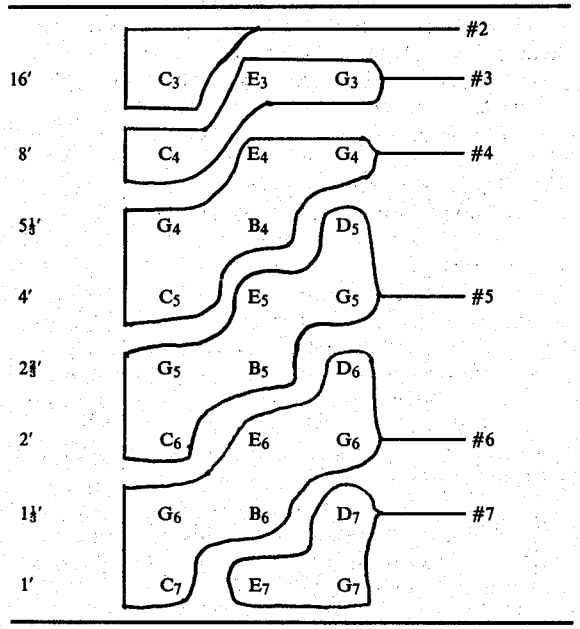

As a second example, to be considered in conjunction with FIG. 2, assume that the chord $G_4$, $B_4$, $D_5$ is played. Both the notes $G_4$ and $B_4$ are in the same octave which carries the binary encoded designation of 100. The note $D_5$ is in octave number 5 which is identified by the three bit binary number 101. In establishing the settings of the switches of FIG. 2, it should be noted that the notes $G_4$ and $B_4$ both are greater-than-seven; so a binary 1 appears on this control lead, causing the switches of the leftmost bank of switches in FIG. 2 to be in their "up" position for those two notes. For the note $D_5$ this bank of switches is in its lowermost position since the note D is lower than the seventh note in the notes of the octave.

For octave number 4 (for the notes $G_4$ and $B_4$) the settings of the three right-hand banks of switches are the same as described above for the settings of the switches for the notes $E_4$ and $G_4$ in the previous example. For the octave assignment 40 associated with the top octave synthesizer circuit producing the note $D_5$, the centermost one of the three octave banks of switches are in the "down" position and the other two are in the "up" position.

For the different flute footages, the output tones appearing on the various flute output buses from the three different synthesizer circuits and their associated octave assignment circuits 40 are in accordance with Chart below:

CHART 2

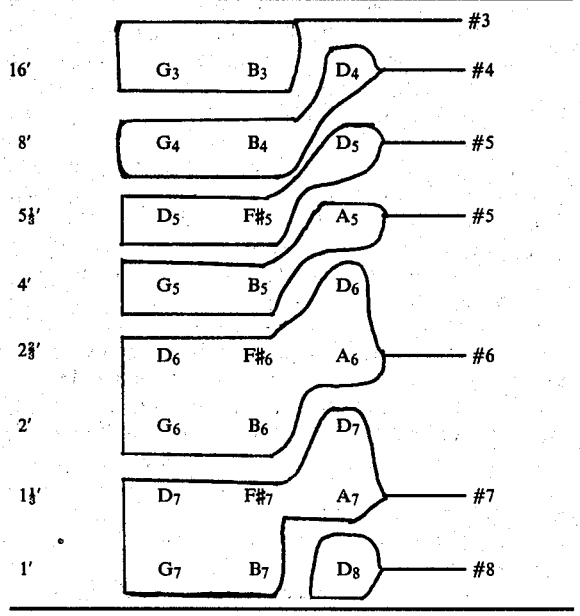

Various other examples could be illustrated, but it is believed that the foregoing examples of two different chords are sufficient to indicate the manner in which the tones for the different octaves are routed through the octave assignment circuits 40 to the proper output octave buses. The result is that each of the output octave buses 50A through 50H has tones on it only for the tones produced by the system within that particular octave. As a consequence, the filtering subsequently used for the signals on the various octave output buses 50A to 50H can be much more readily implemented than if an extremely wide-band filter for the entire bandwidth of all of the notes in the organ were employed at the output of each TOS circuit.

Reference now should be made to FIG. 3 which shows a linear gate circuit such as the linear gate circuits 42 and 55 of FIG. 1. Specifically, the gate circuit shown in FIG. 3 is illustrative of the gate circuit 42 of FIG. 1. These gate circuits comprise a keyer circuit consisting of two field effect transistor (FET) pass gates in series in each of the octave output leads from the octave assignment 40. As illustrated in FIG. 3, the first of these series pass gate FET transistors is a transistor 70 and the second is a transistor 80. The transistors 70A and 80A are connected in series with the first octave output bus 50A. Similar transistors are series connected in each of the other output buses 50B to 50H, with transistors 70H and 80H connected in series with the output octave bus 50H.

The gates of the transistors 70A through 70H are all connected in parallel to the output from the keyer and attack logic circuit 44, so that the gates of these transistors are connected by way of time slot options from the pedestal or envelope generated by the logic circuit 44. The second transistors 80A through 80H in the series gate circuits have their gates connected in parallel to a potential which is supplied by the external mute circuit on the lead 47 (FIG. 1).

If the mute line is taken all the way to the cut-off potential available, the mute is active and cuts off the passage of signals through the gate to any of the octave output buses 50A through 50H. If this potential is somewhere between a full cut-off potential and a potential equal to the full cut-off potential less the threshold potential of the transistors, the muting signal affects the signal level without complete cut off of the transistors. Thus, by varying the potential of the voltage applied to the lead 47 through the potentiometer 48, the amplitude or signal level of all of the signal outputs from a given system can be adjusted, and this adjustment may be used to balance all of the different note generation systems with one another. Once this has been done, the presence of an envelope including the attack, sustain and decay characteristics of the tones applied to the output buses 50A through 50H from any given tone generating circuit depends upon the characteristics and timing of the keyer and attack decay logic circuit 44 supplying signals to the linear gate circuit 42 over the leads 46.

The foregoing description has been limited to a specific embodiment of the invention, and is to be considered as illustrative only and not as limiting the true scope of the invention as defined in the claims. Various modifications will occur to those skilled in the art without departing from the invention as claimed.

What is claimed is:

1. An electronic musical instrument including in combination:

a plurality of tone generator means each capable of producing a plurality of tone signals of different frequencies in more than one of a plurality of different octaves in response to note and octave information;

a plurality of subgroup assignment circuit means each coupled to a different associated tone generator means and each having a plurality of octave subgroup output leads each corresponding to a different octave, said subgroup assignment circuit means in response to at least the octave information of each tone signal coupling each tone signal to the respective octave subgroup output lead corresponding to the octave subgroup in which said tone signal belongs;

a plurality of octave subgroup buses each for a different octave; and means for coupling corresponding octave subgroup output leads from each of said subgroup assignment circuit means together to a different one of said plurality of octave subgroup buses;

whereby the tone signals of the same octave from each of a plurality of tone generator means are combined together on an output bus corresponding to said same octave.

2. The combination according to claim 1 wherein each of said tone generator means is capable of producing any tone signal in any octave in the musical instrument, and each of said subgroup assignment circuit means comprises a switching tree circuit responsive to octave information for coupling each tone signal to the respective octave subgroup output lead corresponding to the octave subgroup in which the tone signal belongs.

3. The combination according to claim 1 further including linear keyer gate switching means connected between each of the output leads of said subgroup assignment circuit means and said octave subgroup buses.

4. The combination according to claim 3 wherein all of said linear keyer gate switching means connected to the output leads of each different subgroup assignment circuit means are operated simultaneously in parallel.

5. The combination according to claim 1 further including pitch coupler circuit means connected to each of said tone generator means and providing related coupler tone pitches on a plurality of outputs thereof in response to tone signals; each of said plurality of subgroup assignment circuit means having inputs connected to the outputs of the pitch coupler circuit means to receive the selected coupler tone pitches from said coupler circuit means; said subgroup assignment circuit means coupling the outputs of pitch coupler circuit means to the corresponding octave subgroup output leads of subgroup assignment circuit means for the tones appearing on the coupler tone inputs.

6. The combination according to claim 5 wherein said subgroup assignment circuit means further includes switching means for interconnecting pitch coupler output leads for nonunison coupler pitches to another octave subgroup whenever the octave of the tone signal being produced by the corresponding tone generator means is different from that of the octave subgroup in response to the note information.

* * * * *